US009293868B2

(12) United States Patent
Tally et al.

(10) Patent No.: US 9,293,868 B2
(45) Date of Patent: Mar. 22, 2016

(54) ATTACHMENT RING FOR ATTACHING A SHIELD OF A CABLE TO A SHELL

(71) Applicant: Tyco Electronics Corporation, Berwyn, PA (US)

(72) Inventors: Paul Craig Tally, Santa Clara, CA (US); Thomas D. Ratzlaff, Menlo Parak, CA (US); Inho Myong, Newark, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/164,040

(22) Filed: Jan. 24, 2014

(65) Prior Publication Data

US 2015/0214671 A1 Jul. 30, 2015

(51) Int. Cl.

| | |
|---|---|
| ***H01R 13/6592*** | (2011.01) |
| ***H01R 4/01*** | (2006.01) |
| ***H01R 13/6581*** | (2011.01) |
| ***H01R 9/05*** | (2006.01) |
| ***H01R 13/6593*** | (2011.01) |
| *H01R 9/03* | (2006.01) |
| *H01R 24/56* | (2011.01) |

(52) U.S. Cl.

CPC ..... *H01R 13/6592* (2013.01); *H01R 9/0524* (2013.01); *H01R 13/6581* (2013.01); *H01R 13/6593* (2013.01); *H01R 4/01* (2013.01); *H01R 9/032* (2013.01); *H01R 24/568* (2013.01)

(58) Field of Classification Search

CPC ..... H01R 4/646; H01R 13/658; H01R 4/01; H01R 9/032; H01R 2103/00; H01R 13/6592; H01R 13/6593

See application file for complete search history.

(56) References Cited

U.S. PATENT DOCUMENTS

| | | | | |
|---|---|---|---|---|
| 3,281,756 | A * | 10/1966 | O'Keefe et al. | 439/320 |
| 3,644,874 | A * | 2/1972 | Hutter | 439/322 |
| 4,243,290 | A | 1/1981 | Williams | |
| 4,902,249 | A * | 2/1990 | Morishita et al. | 439/607.41 |
| 4,921,449 | A * | 5/1990 | Fish | 439/607.41 |
| 5,637,830 | A * | 6/1997 | Hashizawa et al. | 174/84 R |
| 6,048,227 | A * | 4/2000 | Rupp et al. | 439/607.41 |
| 7,074,087 | B2 * | 7/2006 | Szczesny et al. | 439/607.41 |
| 8,167,653 | B2 * | 5/2012 | Hasegawa et al. | 439/607.41 |
| 2005/0142942 | A1 | 6/2005 | Hayashi | |
| 2005/0215122 | A1 | 9/2005 | Nishida | |
| 2012/0115363 | A1 * | 5/2012 | Myong | 439/607.41 |
| 2012/0190238 | A1 | 7/2012 | Omae | |

FOREIGN PATENT DOCUMENTS

| | | | |
|---|---|---|---|
| EP | 2648295 | A1 | 10/2013 |
| GB | 2182212 | A1 | 5/1987 |

OTHER PUBLICATIONS

International Search Report for International Application No. PCT/US2015/012533, mailed Apr. 20, 2014.

* cited by examiner

*Primary Examiner* — Gary Paumen

(57) ABSTRACT

An electrical connector includes a cable having a shield, a shell and an attachment ring for attaching the shield to the fitting. The shell extends between a mating end and a cable end. The shell has a fitting at the cable end. The shell has a cavity receiving an end of the cable through the fitting. The attachment ring is received inside the shield and the fitting. The attachment ring presses the shield outward against an inner surface of the fitting. The shield may be positioned radially inside of the fitting and the attachment ring may be positioned radially inside of the shield. A radially outer edge of the attachment ring may impart an outward radial load onto the shield.

13 Claims, 3 Drawing Sheets

ATTACHMENT RING FOR ATTACHING A SHIELD OF A CABLE TO A SHELL

BACKGROUND OF THE INVENTION

The subject matter described and/or illustrated herein relates generally to attachment rings for attaching a shield of a cable to a shell.

Many cables include an electrically conductive shield that extends around one or more insulated electrical conductors of the cable. The shield blocks electrical interference between the electrical conductors of the cable and the electrical conductors of neighboring cables and/or other neighboring electrical devices. An end of a cable is sometimes terminated to an electrical connector to facilitate electrical connection of the cable to another cable or another electrical device. When terminated to an electrical connector, the shield of the cable may be attached to a backshell that is connected to the electrical connector. The backshell may be used, for example, to protect, electrically shield, and/or provide strain relief to the connection points between the electrical conductors of the cable and the corresponding electrical contacts of the electrical connector.

One method of attaching the shield of the cable to a backshell includes receiving an end of the shield over a fitting of the backshell. An attachment ring is positioned around the outside of the shield and the cable and clamped thereto to secure the end of the shield on the fitting. Specifically, the attachment ring is positioned to extend around the outer circumference of the shield end. Such attachment rings increase the outer diameter of the electrical connector, and thus require larger openings or spaces to route the cable and electrical connector. A need remains for an attachment ring having a low profile.

BRIEF SUMMARY OF THE INVENTION

In one embodiment, an electrical connector is provided that includes a cable having a shield, a shell and an attachment ring for attaching the shield to a fitting of the shell. The shell extends between a mating end and a cable end. The shell has the fitting at the cable end. The shell has a cavity receiving an end of the cable through the fitting. The attachment ring is received inside the shield and the fitting. The attachment ring presses the shield outward against an inner surface of the fitting.

Optionally, the shield may be positioned radially inside of the fitting and the attachment ring may be positioned radially inside of the shield. The attachment ring may include an annular body having a radially inner edge and a radially outer edge. The radially outer edge may impart an outward radial load onto the shield. The shield and attachment ring may be received in the cavity. The attachment ring may be positioned between a conductor of the cable and the shield.

Optionally, the attachment ring may be movable between a compressed state and an expanded state. A diameter of the attachment ring may be greater in the expanded state. The attachment ring may press the shield outward against the inner surface of the fitting when in the expanded state. The attachment ring may be movable between the compressed state and the expanded state based on a temperature of the attachment ring. Optionally, the fitting may be movable between a compressed state and an expanded state. A diameter of the fitting may be greater in the expanded state. The fitting may be movable between the compressed state and the expanded state based on a temperature of the fitting. During assembly, the attachment ring may be cooled to the compressed state and the fitting may be heated to the expanded state such that the attachment ring may be positioned inside the fitting. The attachment ring may be heated to the expanded state and the fitting may be cooled to the compressed state after the attachment ring is positioned inside the fitting causing the attachment ring to press the shield against the inner surface of the fitting.

Optionally, the fitting may be tapered. The attachment ring may be loaded into the fitting until the attachment ring and shield engage the fitting in an interference fit. The inner surface of the fitting may include internal threads. The attachment ring may include external threads. The attachment ring may be threadably coupled to the fitting with the shield sandwiched between the internal threads and the external threads.

Optionally, the attachment ring may include an annular body having a shape memory material that is heat recoverable from a compressed state to an expanded state. The attachment ring may be received inside the shield and the fitting in the compressed state prior to being expanded to the expanded state. The attachment ring may press the shield outward against the inner surface of the fitting in the expanded state. Optionally, the attachment ring may have a corrugated shape in the compressed state and a circular shape in the expanded state. The corrugated shape may have a shorter circumference than the circular shape.

Optionally, the shield may include a cable braid and a braid sock separate from the cable braid. The braid sock may be captured between the attachment ring and the fitting and may extend rearward therefrom for termination to the cable braid. The braid sock may be mechanically and electrically connected to the cable braid rearward of the fitting.

In another embodiment, an electrical connector is provided including a cable having a shield, a shell and an attachment ring for attaching the shield to the fitting. The shell extends between a mating end and a cable end. The shell has a fitting at the cable end. The shell has a cavity receiving an end of the cable through the fitting. The attachment ring has an annular body comprising a shape memory material that is heat recoverable from a compressed state to an expanded state. The attachment ring is received inside the shield and the fitting in the compressed state prior to being expanded to the expanded state. The attachment ring presses the shield outward against an inner surface of the fitting in the expanded state.

In a further embodiment, an electrical connector is provided that includes a cable having a shield, a shell and an attachment ring for attaching the shield to the fitting. The shell extends between a mating end and a cable end. The shell has a fitting at the cable end. The fitting has internal threads along an inner surface of the fitting. The shell has a cavity receiving an end of the cable through the fitting. The attachment ring has external threads. The attachment ring is received inside the shield and the fitting such that the external threads of the attachment ring are threadably coupled to the internal threads of the fitting with the shield captured between the external threads and the internal threads. The attachment ring presses the shield outward against the fitting to make an electrical connection between the shield and the shell.

DETAILED DESCRIPTION OF SPECIFIC EMBODIMENTS OF THE INVENTION

Figure 1:
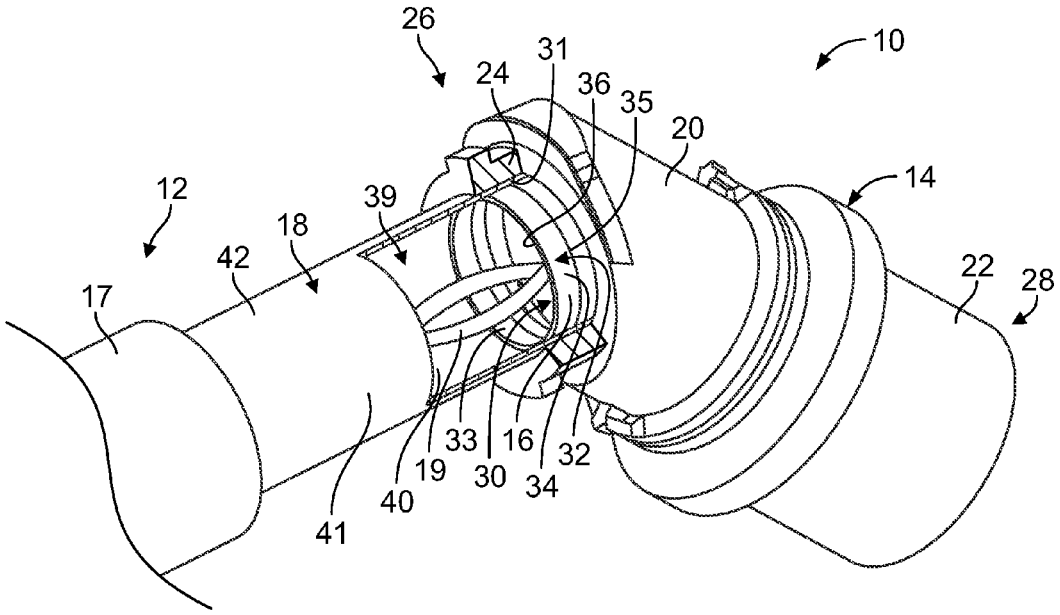
FIG. 1 is a perspective view of a portion of an exemplary embodiment of an electrical connector, showing a partial section thereof.
Figure 2:
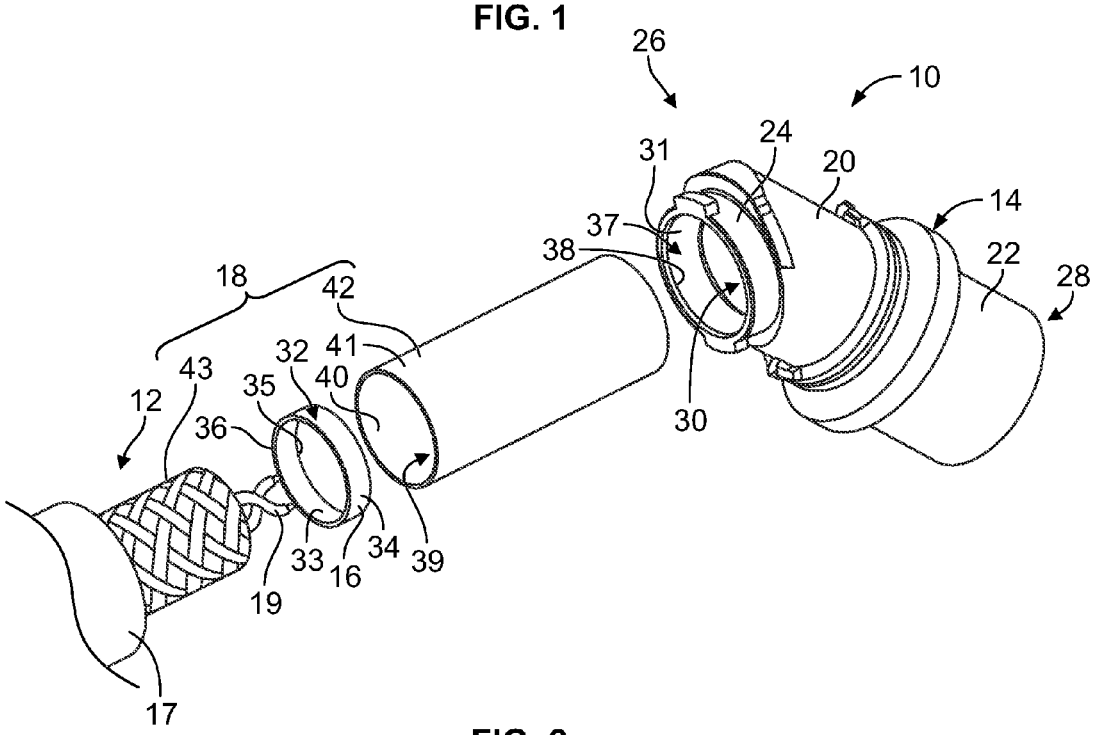
FIG. 2 is an exploded view of the electrical connector.

FIG. 1 is a perspective view of an exemplary embodiment of an electrical connector 10, showing a partial section thereof. FIG. 2 is an exploded view of the electrical connector 10. The electrical connector 10 includes a cable 12, a shell 14, and an attachment ring 16. The attachment ring 16 is used to attach the shield 18 to the shell 14. The attachment ring 16 may be used to mechanically and electrically connect the shield 18 to the shell 14. The attachment ring 16 may be used as a retention device to lock the shield 18 to the shell 14. In an exemplary embodiment, the attachment ring 16 is received inside of the shield 18 and the shell 14 and provides a pressing force in an outward direction to clamp the shield 18 against the shell 14. The attachment ring 16 imparts an outward radial load onto the shield 18 to mechanically and electrically connect the shield 18 to the shell 14.

The cable 12 includes a cable jacket 17, a shield 18 and at least one conductor 19, such as a wire, surrounded by the shield 18 and the cable jacket 17. Some or all of the conductors 19 may be configured to carry electrical data signals. Optionally, the conductors 19 may be arranged as a differential pair(s) of signal conductors. Some or all of the differential pairs are optionally arranged as twisted wire pairs. In some embodiments, one or more of the conductors 19 may be configured to carry electrical power and/or electrical ground. Although shown as having a cylindrical shape, the cable 12 may additionally or alternatively include any other shape, such as, but not limited to, a flat shape, a parallelepiped shape, and/or the like.

In the illustrated embodiment, the shell 14 is a multi-piece shell including a backshell 20 and a front housing 22. The backshell 20 includes a fitting 24 at a cable end 26 of the shell 14. The fitting 24 may be any part of the shell 14 to which the shield 18 may be fit or attached. The fitting 24 may have any appropriate size or shape for interfacing with the shell 14. While the fitting 24 is illustrated as being an extension of reduced diameter at the cable end 26 of the shell, the fitting 24 is not limited to such structure. The fitting 24 may be internal to the shell 14. The fitting 24 may be the same size and shape or may be larger than the other parts of the shell 14. While the shell 14 is illustrated as being a 45° shell with the opening at the cable end 26 oriented at 45° with respect to the front of the shell 14, it is realized that other types of shells may be used in alternative embodiments, such as a right angle shell, a straight pass through shell, or another type of shell.

In an exemplary embodiment, the cable 12 is loaded into the shell 14 through the fitting 24. The front housing 22 defines a mating end 28 of the electrical connector 10, which may be mated with another electrical connector. The front housing 22 may house one or more terminals or contacts that are terminated to corresponding conductors 19 of the cable 12 inside a cavity 30 of the shell 14. The front housing 22 may house a circuit board or may include an electrical connector where conductors 19 of the cable 12 are terminated to the circuit board or electrical connector inside the cavity 30 of the shell 14. The backshell 20 may be connected to the front housing 22 by a threaded coupling nut or by other means. In alternative embodiments, the shell 14 may be a single piece housing or may include an upper shell and a lower shell that both extend the length of the shell 14 between the cable end 26 and the mating end 28.

The attachment ring 16 comprises an annular body 32 that is fitted inside the shield 18 and inside the fitting 24. The attachment ring 16 has a circumference that is less than a circumference of the shield 18 (at the end) and less than a circumference of an inner surface 31 of the fitting 24. In an exemplary embodiment, the attachment ring 16 is fabricated from one or more shape memory materials that recover upon exposure to a heat source. The attachment ring 16 may be fabricated from shape memory materials, such as, but not limited to, a titanium/nickel-based alloy, a titanium/nickel/niobium alloy, a titanium/nickel/iron alloy, a copper based alloy, and/or the like. The attachment ring 16 is movable between a compressed state and an expanded state when heat is applied to the attachment ring 16, such as at a temperature of 150 degree Celsius or higher. In other words, at least a portion of the body of the attachment ring 16 is heat recoverable such that at least a portion of the body expands upon the application of heat thereto.

During assembly, the attachment ring 16 is compressed, such as radially inward, into a preconditioned shape that is smaller in diameter in the compressed state than the diameter of the attachment ring 16 in the expanded state. The attachment ring 16, in the compressed state, is installed into position inside the shield 18 and inside the fitting 24 and then heated to expand the attachment ring 16. When the attachment ring 16 is expanded, the attachment ring 16 locks the shield 18 to the inside of the fitting 24, such as against the inner surface 31 of the fitting 24. Optionally, the attachment ring 26 may be additionally secured to the shield 18, such as by soldering, brazing, welding or other means of attachment. Optionally, the shield 18 may be additionally secured to the fitting 24, such as by soldering, brazing, welding or other means of attachment.

The attachment ring 16 includes an inner edge 33 and an outer edge 34. The attachment ring 16 extends between a front end 35 and a rear end 36. Optionally, the outer edge 34 of the attachment ring 16 may be tapered between the front and rear ends 35, 36. The outer edge 34 faces the shield 18 and presses against the shield 18 to impart the outward radially load onto the shield 18 that mechanically and electrically connects the shield 18 to the shell 14. Optionally, the outer edge 34 may be smooth. Alternatively, the outer edge 34 may be textured to increase friction and/or stiction between the attachment ring 16 and the shield 18 to mechanically secure the shield 18 in place. For example, the outer edge 34 may include ridges, grooves, a knurled surface, openings, windows or other features. Optionally, the outer edge 34 may be threaded and may threadably couple to corresponding threads on the inner surface 31 of the fitting 24, with the shield 18 sandwiched therebetween.

Optionally, the inner surface 31 of the fitting 24 may include a groove 37 that receives a portion of the shield 18 and the attachment ring 16. For example, the attachment ring 16 may expand outward against the shield 18 forcing the shield and possibly at least part of the attachment ring 16 therein. The groove 37 is defined by at least one ridge or shoulder 38. The shoulder 38 helps hold the attachment ring 16 and shield 18 in the fitting 24, such as by restricting rearward pulling or slippage out of the fitting 24.

The shield 18 extends around the insulated conductors 19 along at least a portion of the length of the cable 12. The shield 18 includes a central passageway 39 that extends along the length of the shield 18 and receives the conductor 19 therein. An inner surface 40 of the shield 18 defines the central passageway 39. The attachment ring 16 is also received in the central passageway 39 and presses against the inner surface 40. The attachment ring presses an outer surface 41 of the shield 18 against the fitting 24 to electrically connect the shield 18 to the shell 14.

When assembled, the shield 18 extends rearward from the fitting 24 to provide electrical shielding of the conductors 19 of the cable 12, such as from the electrical conductors (not shown) of neighboring cables (not shown) and/or other neighboring electrical devices (not shown). The shield 18 may be electrically connected to an electrical ground or other electrical source at one or both ends of the cable 12. For example, the fitting 24 of the shell 14 may provide an electrical connection between the end of the shield 18 and an electrical ground or other electrical source.

The shield 18 may be fabricated from any electrically conductive materials having any structure, such as, but not limited to, a conductive fabric, a conductive tape, a metallic (e.g., copper and/or the like) foil, aluminum/polyester (e.g., polyethylene terephthalate) tape, a conductive sleeve formed from one or more sheets of material, a braid of electrical conductor strands, and/or the like. In an exemplary embodiment, and as can be seen in FIGS. 1 and 2, the shield 18 is fabricated from a braid of electrical conductor strands.

Optionally, the shield 18 may be a multi-piece shield. For example, the shield 18 may include a braid sock 42 and a cable braid 43. The braid sock 42 is configured to be coupled to the fitting 24 and then coupled to the cable braid 43. For example, the attachment ring 16 is used to mechanically and electrically couple one end of the braid sock 42 to the fitting 24 and the other end of the braid sock 42 is welded, crimped or otherwise mechanically and electrically connected to the cable braid 43. The cable braid 43 is integrated with the conductors 19 and the cable jacket 17 during a cabling process and may be loaded into the passageway of the braid sock 42 after the braid sock 42 is secured to the fitting 24. It may be easier to attach the braid sock 42 to the fitting 24 using the attachment ring 16 because the attachment ring 16 can be loaded through the rear end of the braid sock 42. However, the attachment ring 16 may be loaded into the fitting 24 through the front, such as through the cavity 30 in alternative embodiments.

In an exemplary embodiment, the fitting 24 may be expanded and compressed in addition to the attachment ring 16. For example, the fitting 24 may be movable between a compressed state and an expanded state with a diameter of the fitting 24 being greater in the expanded state. By expanding the fitting 24 and contracting the attachment ring 16, the attachment ring 16 may be more easily positioned in the fitting 24 with the shield 18 positioned therebetween. Once positioned, the fitting 24 may be compressed and the attachment ring 16 may be expanded to capture the shield 18 therebetween. The fitting 24 may be movable between the compressed state and the expanded state based on a temperature of the fitting 24. In an exemplary embodiment, prior to assembly, the attachment ring 16 is cooled to the compressed state and the fitting 24 is heated to the expanded state such that the attachment ring 16 may be positioned inside the fitting 24. Once positioned, the attachment ring 16 is heated to the expanded state and the fitting 24 is cooled to the compressed state, causing the attachment ring 16 to press the shield 18 against the inner surface 31 of the fitting 24. The expansion and contraction of the fitting 24 and attachment ring 16 may be accomplished with or without the use of shape memory materials. For example, the amount of expansion and contraction of non-shape memory materials may be enough to position the shield 18 and attachment ring 16 in the fitting 24 and then achieve appropriate radial loads on the shield 18.

Figure 3:
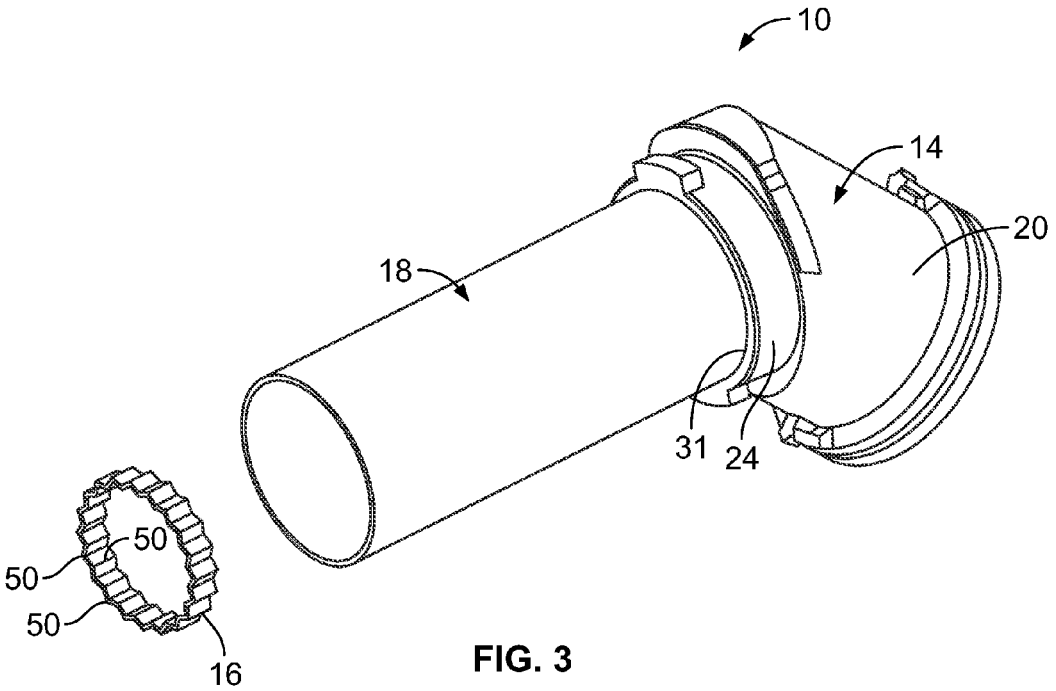
FIG. 3 is a partially assembled view of the electrical connector showing an attachment ring thereof in a compressed state and poised for loading into a shield and fitting of the electrical connector.
Figure 4:
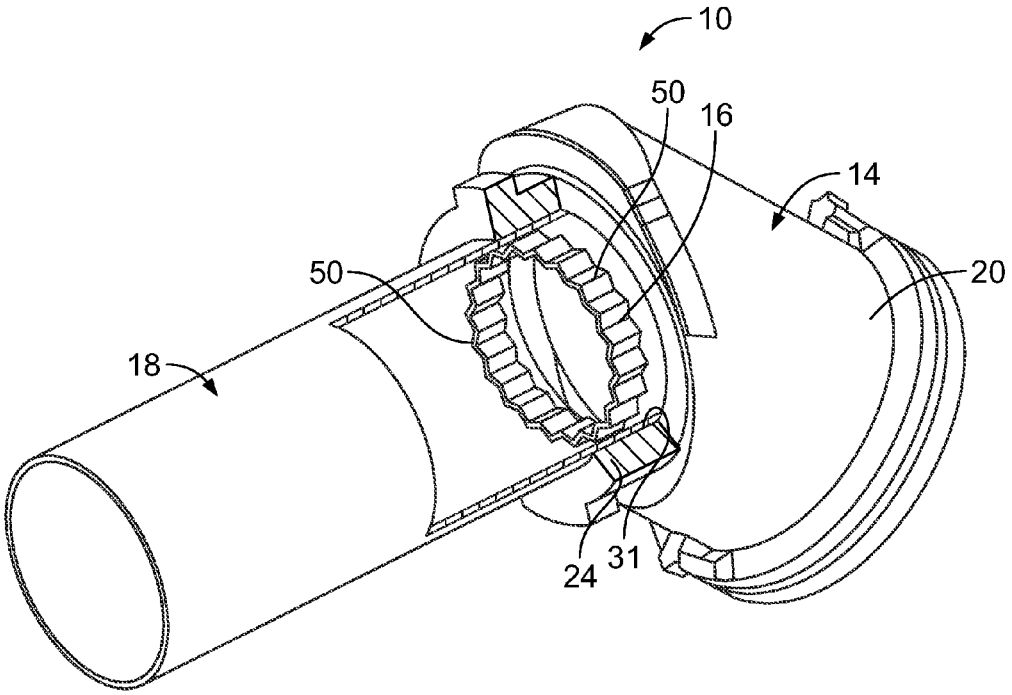
FIG. 4 is a partial sectional view of the electrical connector showing the attachment ring positioned inside the shield and fitting.
Figure 5:
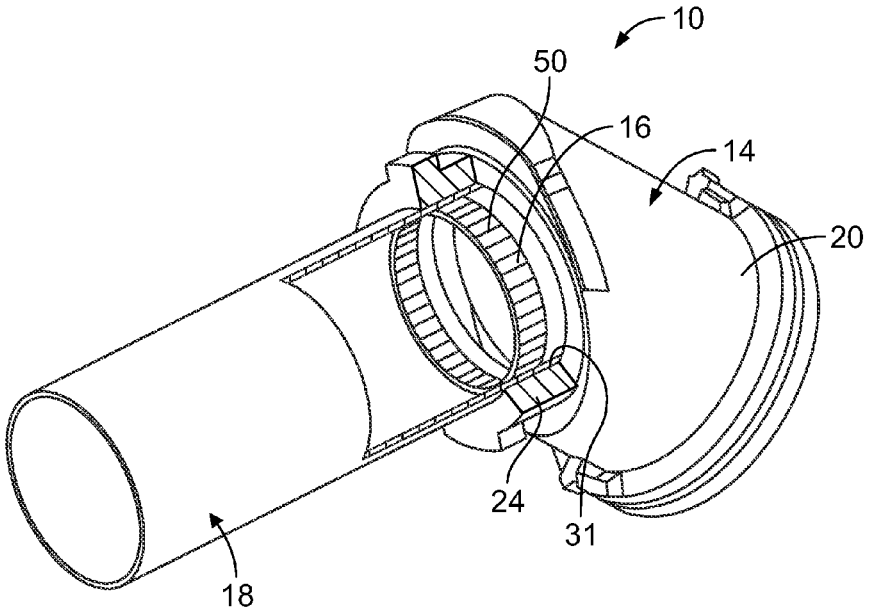
FIG. 5 is a partial sectional view of the electrical connector showing the attachment ring in an expanded state.

FIG. 3 is a partially assembled view of the electrical connector 10 showing the attachment ring 16 in a compressed state and poised for loading into the shield 18 and fitting 24. FIG. 4 is a partial sectional view of the electrical connector 10 showing the compressed attachment ring 16 positioned inside the shield 18 and fitting 24. FIG. 5 is a partial sectional view of the electrical connector 10 showing the attachment ring 16 in an expanded state.

The attachment ring 16 is fabricated from one or more shape memory materials. In the illustrated embodiment shown in FIG. 3, and contrary to the embodiment illustrated in FIG. 1, the attachment ring 16 is compressed into a corrugated shape having a series of ridges 50 around the attachment ring 16. Optionally, the attachment ring 16 may be radially and inwardly deformed in one or more places to achieve reduction of the outer diameter of the attachment ring 16. The attachment ring 16 may have a uniform wall thickness along the circumferential length of the attachment ring 16. Corrugating the attachment ring 16 reduces the effective length of the circumference, which reduces the outer diameter of the attachment ring 16. The reduced size, in the corrugated or compressed state, allows the attachment ring 16 to more easily be placed inside the shield 18 and the shell 14 (only the backshell 20 is illustrated). The attachment ring 16 recovers in a radially outward direction, such as when heated, and may recover to a circular shape. The attachment ring 16 may not be able to recover to a completely circular shape due to interference with the shield 18 and fitting 24, where the attachment ring 16 is still partially corrugated, but the corrugated sections are further spread out than in the compressed state. The attachment ring 16 has a larger diameter in the recovered or expanded state thus increasing the effective length of the circumference. The expanded compliance as the attachment ring 16 recovers to the expanded state allows the attachment ring 16 to compress the shield 18 against the inner surface 31 of the fitting 24.

Optionally, the attachment ring 16 may be fabricated from a flat sheet of material that is then corrugated and cut to size (e.g. length and width). The sheet may then be formed into a ring shape by coupling the ends together, such as by welding, using tongue and groove features, and the like.

Figure 6:
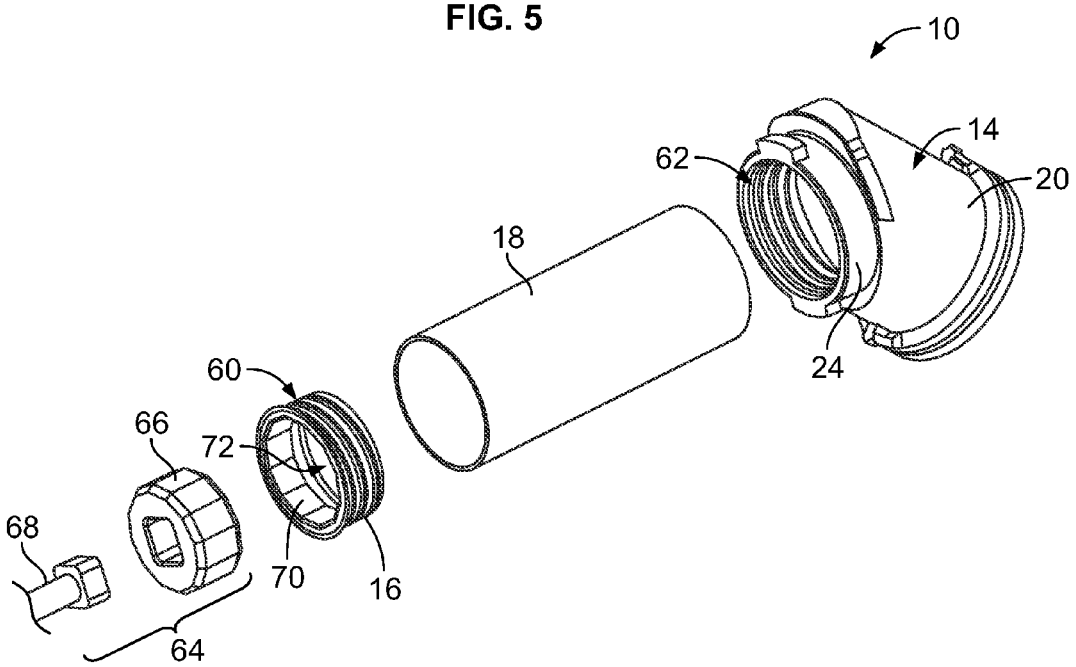
FIG. 6 is an exploded view of the electrical connector showing the attachment ring and fitting with threads.

FIG. 6 is an exploded view of the electrical connector 10 showing the attachment ring 16 with external threads 60 and the fitting 24 with internal threads 62. The shield 18 is configured to be captured between the threads 60, 62 when the attachment ring 16 is threadably coupled to the fitting 24. The threads 60, 62 may be shallow threads to allow the shield 18 to be positioned therebetween without binding or damaging the shield 18. The attachment ring 16 does not need to be manufactured from a shape memory material, but rather may be made from any metal or composite material. The attachment ring 16 does not necessarily change shape. Optionally, the fitting 24 may be tapered to allow the attachment ring 16 to tighten into the fitting 24 as the attachment ring 16 is threadably coupled to the fitting 24.

In an exemplary embodiment, a drive tool 64, having a head 66 and a shaft 68, is used to threadably couple the attachment ring 16 to the fitting 24. The attachment ring 16 includes drive walls 70 that are engaged by the head 66. As the shaft 68 is rotated, the head 66 engages the drive walls 70 and rotates the attachment ring 16. The drive tool 64 is removed from the attachment ring 16 to allow the cable 12 (shown in FIG. 1) to be loaded through an internal passage 72 of the attachment ring 16 into the shell 14 (only the backshell 20 is illustrated).

The embodiments described and/or illustrated herein may provide an attachment ring that is attached from the inside of the shell to attach the shield to the shell. Both the attachment ring and the shield are received inside the fitting of the shell, thus reducing the overall size of the cable end of the shell. The embodiments described and/or illustrated herein provide effective EMI shielding for the cable as the shield is terminated inside the fitting and no gaps or leakage areas are formed. The embodiments described and/or illustrated herein achieve low direct current resistance between the shield and the shell. The embodiments described and/or illustrated herein provide a method of attaching the braid to the fitting with minimal shield deformation during installation of the attachment ring.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a cable having a shield;

a shell extending between a mating end and a cable end, the shell having a fitting at the cable end, the shell having a cavity receiving an end of the cable through the fitting; and an attachment ring for attaching the shield to the fitting, the attachment ring being received inside the shield and the fitting and pressing the shield outward against an inner surface of the fitting, wherein the inner surface of the fitting includes internal threads, the attachment ring includes external threads, the attachment ring being threadably coupled to the fitting with the shield sandwiched between the internal threads and the external threads.

2. The electrical connector of claim 1, wherein the shield is positioned radially inside of the fitting and the attachment ring is positioned radially inside of the shield.

3. The electrical connector of claim 1, wherein the shield and attachment ring are received in the cavity.

4. The electrical connector of claim 1, wherein the cable comprises a conductor, the attachment ring being positioned between the conductor and the shield.

5. The electrical connector of claim 1, wherein the fitting is tapered, the attachment ring being loaded into the fitting until the attachment ring and shield engage the fitting in an interference fit.

6. An electrical connector comprising:

a cable having a shield;

a shell extending between a mating end and a cable end, the shell having a fitting at the cable end, the shell having a cavity receiving an end of the cable through the fitting; and an attachment ring for attaching the shield to the fitting, the attachment ring being received inside the shield and the fitting and pressing the shield outward against an inner surface of the fitting, wherein the attachment ring includes an annular body comprising a shape memory material that is heat recoverable from a compressed state to an expanded state, the attachment ring being received inside the shield and the fitting in the compressed state prior to being expanded to the expanded state, the attachment ring pressing the shield outward against the inner surface of the fitting in the expanded state, and wherein the attachment ring has a corrugated shape in the compressed state and a circular shape in the expanded state, the corrugated shape having a shorter circumference than the circular shape.

7. An electrical connector comprising:

a cable having a shield;

a shell extending between a mating end and a cable end, the shell having a fitting at the cable end, the shell having a cavity receiving an end of the cable through the fitting; and an attachment ring for attaching the shield to the fitting, the attachment ring being received inside the shield and the fitting and pressing the shield outward against an inner surface of the fitting wherein the shield includes a cable braid and a braid sock separate from the cable braid, the braid sock being captured between the attachment ring and the fitting and extending rearward therefrom for termination to the cable braid, the braid sock being mechanically and electrically connected to the cable braid rearward of the fitting.

8. An electrical connector comprising:

a cable having a shield;

a shell extending between a mating end and a cable end, the shell having a fitting at the cable end, the shell having a cavity receiving an end of the cable through the fitting; and an attachment ring for attaching the shield to the fitting, the attachment ring having an annular body comprising a shape memory material that is heat recoverable from a compressed state to an expanded state, the attachment ring being received inside the shield and the fitting in the compressed state prior to being expanded to the expanded state, the attachment ring pressing the shield outward against an inner surface of the fitting in the expanded state, wherein the attachment ring has a corrugated shape in the compressed state and a circular shape in the expanded state, the corrugated shape having a shorter circumference than the circular shape.

9. The electrical connector of claim 8, wherein the shield is positioned radially inside of the fitting and the attachment ring is positioned radially inside of the shield.

10. The electrical connector of claim 8, wherein a diameter of the attachment ring is greater in the expanded state than in the compressed state.

11. The electrical connector of claim 8, wherein the attachment ring is movable between the compressed state and the expanded state based on a temperature of the attachment ring.

12. An electrical connector comprising:

a cable having a shield;

a shell extending between a mating end and a cable end, the shell having a fitting at the cable end, the fitting having internal threads along an inner surface of the fitting, the shell having a cavity receiving an end of the cable through the fitting; and an attachment ring for attaching the shield to the fitting, the attachment ring having external threads, the attachment ring being received inside the shield and the fitting such that the external threads of the attachment ring are threadably coupled to the internal threads of the fitting with the shield captured between the external threads and the internal threads, the attachment ring pressing the shield outward against the fitting to make an electrical connection between the shield and the shell.

13. The electrical connector of claim 12, wherein the shield is positioned radially inside of the fitting and the attachment ring is positioned radially inside of the shield.

* * * * *